United States Patent [19]

Hudelmaier

[11] 4,114,193

[45] Sep. 12, 1978

[54] DEVICE FOR THE CONTROL OF CONCRETE MANUFACTURE IN TRUCK CONCRETE MIXERS

[76] Inventor: Gerhard Hudelmaier, Frauenstrasse 22, 7900 Ulm, Donau, Germany

[21] Appl. No.: 679,716

[22] Filed: Apr. 23, 1976

[30] Foreign Application Priority Data

Apr. 23, 1975 [DE] Fed. Rep. of Germany ..... 2518084

[51] Int. Cl.[2] ..... B28C 7/02

[52] U.S. Cl. ..... 366/2; 366/27; 366/34; 366/43; 366/60

[58] Field of Search ..... 259/145, 146, 148, 149, 259/153, 154, 161, 162, 163, 165, 175, 176, 177 R, 177 A; 235/92 T, 132 R

[56] References Cited

U.S. PATENT DOCUMENTS

| | | | |
|---|---|---|---|
| 1,916,745 | 7/1933 | Smith | 259/153 |
| 2,018,964 | 10/1935 | Lindow | 259/153 |
| 2,858,594 | 11/1958 | Eirich | 259/154 |
| 3,460,812 | 8/1969 | Kaufman | 259/177 R |
| 3,608,869 | 9/1971 | Woodle | 259/154 |
| 3,627,281 | 12/1971 | Peterson | 259/177 |
| 3,719,214 | 3/1973 | Erndt | 259/154 |
| 3,822,056 | 7/1974 | Hawes | 259/154 |

*Primary Examiner*—Robert W. Jenkins
*Attorney, Agent, or Firm*—James E. Nilles

[57] ABSTRACT

A system and method to control concrete production employs a loading station and a mixing truck having a rotatable mixing drum for travelling between the loading station and a job site. A control system is provided to insure that properly proportional ingredients loaded into the mixing drum at the loading station are mixed for a predetermined appropriate programmable interval of time, whether the mixing truck remains at the loading station or is in transit to the job site. The control system comprises a first portion installed at the loading station and a second portion mounted on the mixing truck, which portions are coupled together when the mixing truck is at the loading station. The first portion of the control system comprises a first time switch unit for controlling the entire time cycle (loading time and mixing time) in a first program and a second time switch unit for controlling only the loading time in a second program. The second portion of the control system comprises a third time switch unit for controlling only addition of water to the mixing drum and mixing time in the second program, which events occur while the mixing truck is uncoupled from the loading station. Releasable locking mechanisms are provided to prevent premature departure of the mixing truck from the loading station, to prevent drum rotation beyond the appropriate time interval, and to prevent premature dumping of the mixing drum.

27 Claims, 5 Drawing Figures

DEVICE FOR THE CONTROL OF CONCRETE MANUFACTURE IN TRUCK CONCRETE MIXERS

BACKGROUND OF THE INVENTION

1. Field of Use

The invention concerns a system to control the production of concrete in concrete mixer trucks which are equipped with a drum that can be rotated. It also concerns methods for operating said system.

2. Description of the Prior Art

The quality of the concrete depends upon the dosage rate of its components as well as on their mixing which determines the homogeneity. If concrete is ready-mixed in stationary installations and then only loaded into respective vehicles for transportation, the producer can control the quality of the concrete produced but he can not guarantee the working quality of same. This can change during transportation. Furthermore, there is the possibility to mix the measured ingredients in the drum after they have been loaded, whereby mixing can take place at the loading station or elsewhere, preferably at the site where it is going to be used, that is to say at the building site. In the second case the producer has no control over the mixing times. There is a danger that the required mixing times for perfect quality are not observed and possibly that the water dosage rate from the tank is changed.

SUMMARY OF THE PRESENT INVENTION

It is the purpose of this invention to create a system of the above-described type which will not permit any arbitrary intervention into the production process and which will guarantee a concrete quality that is determined by the supplier and is independent of the location of the concrete mixer.

This task is solved by means of a system with a control device which keeps the drive of the drum necessarily switched on for a predetermined mixing duration through a time switch installation.

The control system thus governs the portion of the production process which is either difficult or impossible for the producer to control. If mixing takes place at the loading station, the control system eliminates the necessity for further control of the concrete mixer truck in question following the addition of the measured components. This also eliminates possible errors which could occur during peak periods when several concrete mixer trucks are at the loading station at the same time. Most important, however, is the guarantee provided by the time switching device that the mixing time must be adhered to even if the mixing process takes place away from the loading station, for instance at the building site. The producer can thus give a substantial guarantee for the delivered quality. At the same time the driver of the concrete mixer truck is relieved from his responsibility of watching the necessary mixing time.

Advantageously the control system will have a program selector for at least the first program to be controlled, that is the loading and mixing at the loading station, and for a second program, which is the loading at the loading station and mixing at another location, such as for instance the building site. The workers at the loading station will thus have an easier job. They must only watch over and carry out the premeasuring of the components to be loaded and then make certain that the correct program is selected each time. The remaining process is controlled and further supervision is unnecessary.

The control system may consist of a first portion which is installed at the loading station and a second portion mounted on the concrete mixer truck which can be coupled with the first one. This way a large portion of the control system will only be used once, namely at the loading station, while the concrete mixer truck must only have that portion of the control system mounted which assures that procedures which take place away from the loading station will run as programmed. At the same time it is guaranteed that program selection and possibly necessary changes, such as for instance duration of mixing time, can only be made by authorized personnel at the loading station. Furthermore, all portions of the control system which are to be mounted at the loading station are subject to slighter stresses and to fewer possibilities of damage.

A preferred design features a first time switch unit in the first portion of the control system for loading and mixing time. The first time switch unit thus controls the entire time requirement for the cycle of the first program. Normally this remains unchanged. If there is a change in the drum filling, the loading as well as the mixing time will change proportionally so that a single adjustment on the time control device will suffice.

The time switch system can have a second time switch unit in the first portion of the control system which is intended for the loading time. This controls the time used at the loading station in the second program.

Furthermore, the time switch system has a third time switch unit in the second portion of the control system which can be programmed with the program selector and which controls the addition of water from the tank to the drum and the mixing time during the cycle of the second program. It thus takes over the portion of the second program which takes place away from the loading station. The second portion of the control system is thus relieved of the functions which take place at the loading station.

For a loading station where the amounts of water required for the filling of the drum are not stored, the time switch device in the first portion of the control system can feature a time switch unit to regulate the water supply to the drum or to the tank of the concrete mixer truck. Addition of water is thus measured dependent on time.

Advantageously, the control system will have fixable or releaseable locking mechanism for a coupling between the first and the second portion of the system. The concrete mixer truck can thus not leave the loading station until the programmed cycle which is to take place there is finished and, for the latter case, the second portion of the control system has taken over the control with the third time switch unit.

A predetermined mixing time is guaranteed in a simple manner in that the control system has at least one admissible locking mechanism for at least one actuator of the drum drive which depends on the programming of at least one time switch unit. The locking mechanism can have at least one locking element to fix the actuator in the "mixing" position, which it blocks when the drum drive is switched on and which it will release only after the minimum mixing time has passed to stop the drum.

Furthermore, the locking mechanism can have at least one locking element to block the "emptying" position. It is thus possible, during the cycle of the second program, to drive the concrete mixer truck to the mixing site with the drum containing only the dry components, without having the drum rotate, whereby it is prevented that the drum contents be accidentally dumped without prior addition of water and mixing process.

A simple type of design provides that the locking mechanism for the coupling and the locking mechanism for at least one actuator function with the same locking element.

For an installation with a drum drive actuator which pivots at least for switching, for example a switch lever, the actuator can be equipped with toothed segments which move along during switching and on a control unit carries at least the locking mechanism it is possible to have at least one rack mounted in a displaceable manner which meshes with the toothed segments. Fixation of the rack or limitation of its displacement thus also fixes the actuator or limits its range of adjustment.

Advantageously, the rack in mixing position of the actuator can override the coupling of the control system, whereby it acts as locking element for the locking mechanism. If the first and second portions of the control system are coupled, the coupling of the fixed actuator can not be released and during the mixing operation according to the second program subsequent coupling of the uncoupled portions of the control system is impossible. In this manner it is not possible to intervene in the program cycle.

For fixation, the preferred type of design is equipped with racks with slots into which an armature of a magnet from the control system can be locked in the mixing position of the actuator. The magnet armature constitutes the locking element which prevents movement of the rack while the magnet is under current. This can be switched simply through a time switch unit. The rack or racks can be assigned switches for an electric circuit which loads the magnet or magnets of the control system in such a way that the switches are actuated when the drum drive is switched on. The racks, therefore, cause their own locking at the end of their displacing movement.

Advantageously, the control system can be equipped with a time switch for a minimum remixing time during and/or after transportation and prior to emptying. This guarantees supply of adequately mixed concrete, independent of influences such as length and condition of the transport ways, which may have resulted in separation of the components in the drum.

The tank valve may be equipped with an electric water meter to limit water supply. The water meter can intervene in the second portion of the second program in such a manner that dosage of the water will only take place at the time of mixing at the building site. This has the advantage that a tank with the respective capacity can take in more water than what is required to fill the drum and that it will thus have an additional supply. This additional water can for instance be used for cleaning of the drum after the concrete has been dumped. The water meter must only guarantee that the quality of the concrete will not suffer due to the addition of too much water.

The following method or process is provided for the mixing at the loading station;

Manually: Coupling of the control system portions, selection of Program No. 1, switching of the actuators into "mixing" position;

Automatically: Fixation of the coupling and the actuators, loading of the drum with all the components, including water, mixing for a predetermined period of time, release of the actuators and the coupling;

Manually: Actuators in neutral position, release of the coupling.

Upon completion of this program the drum contains concrete which is ready to be used. If a longer transportation route to the building site is necessary, the actuators are not put into neutral position, but the drum will be kept rotating during the trip.

The following method or process is provided for mixing at the building site:

Manually: Coupling of the control system portions, attaching a water hose to the tank, selection of Program No. 2, switching of the actuators into "mixing" position;

Automatically: Fixation of the coupling, the actuators and the water connection, loading the drum with dry components, filling of the tank with predetermined water dosage, conclusion of the loading process, connecting electric circuit of the second portion of the control system, release of the hose attachment and coupling, as well as putting the actuators into neutral position, simultaneous blocking of their "emptying" position and a tank valve to the drum; trip to the mixing site;

Manually: Connect compressed air to water tank, switching of the actuators to "mixing" position;

Automatically: Blocking of the actuators, opening of the tank valve, mixing during the mixing time cycle on the third time switch unit, closing of the tank valve, complete release of the actuators.

DRAWINGS

An example of a preferred embodiment of the invention is shown in the drawings wherein:

FIG. 1 depicts in a side elevation view a portion of a loading station and a portion of a concrete mixer truck, FIG. 2 depicts a control unit shown in FIG. 1, but showing it in larger dimensions, FIG. 3 depicts the control unit of FIG. 2 in a different operating position, FIG. 4 depicts the control unit of FIGS. 2 and 3 in a further operating position, and FIG. 5 is a schematic diagram for a time switch installation of the control unit.

DESCRIPTION OF A PREFERRED EMBODIMENT

Figure 1:
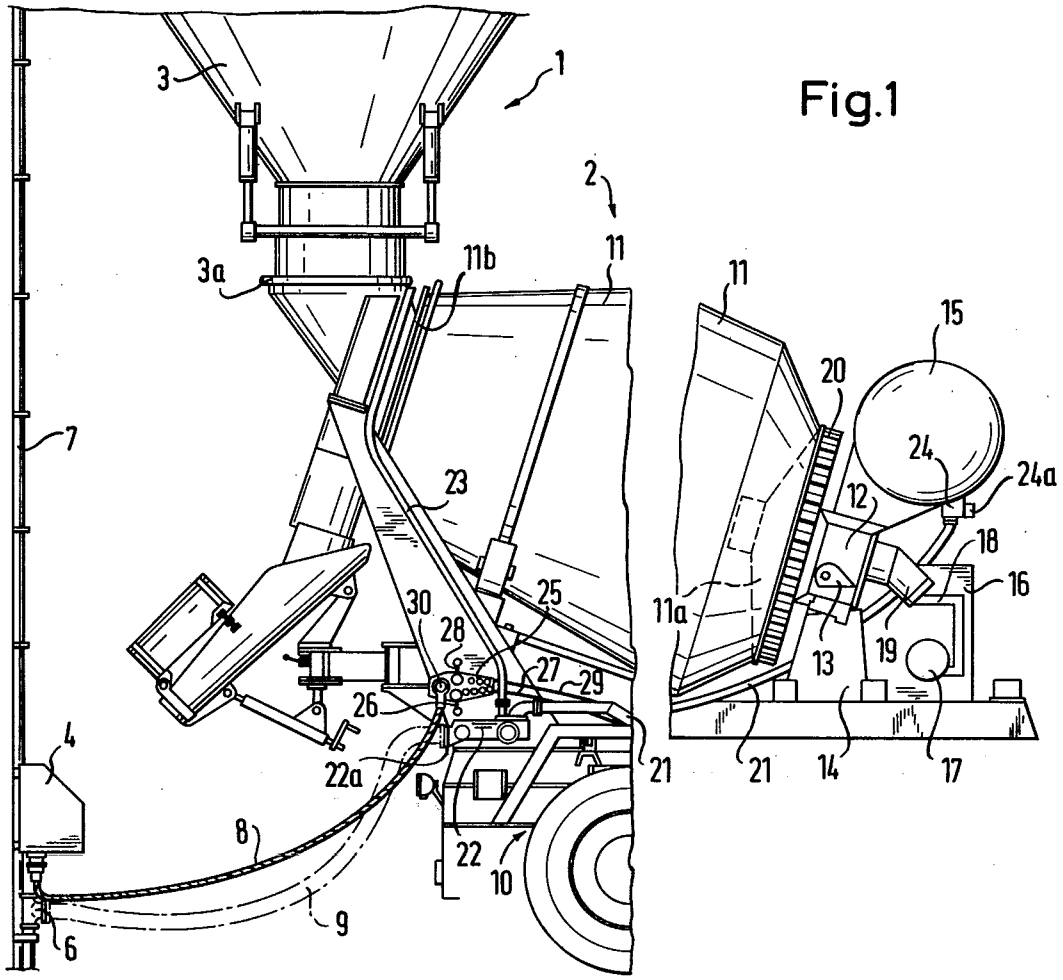

FIG. 1 shows, partly schematized, a loading station designated as a whole with 1 and a concrete mixer truck which is there to be loaded designated as a whole with 2, each shown as a cutaway view. The loading station 1 has the transfer hopper 3 with its closeable discharge opening 3*a*; a switch box 4 for parts of a whole designated as 5, the form of its wiring diagram shown in FIG. 5 time switch system, and a water connection 6. The switch box 4 is mounted on a rod 7 which contains connections and is connected with a control cable 8. A water hose 9 is attached to the water connection 6; the hose can be removed.

The concrete mixer truck 1 has a rotary drum 11 which rests on the undercarriage 10. In its bottom area 11*a* it is supported by a spindle which is not shown in a support bracket 12, which itself is supported by a hinged support 13 on a pillow block 14. The support bracket 12 carries a water tank 15. A drive motor 16 is provided for the rotary drive of the drum which drives a hydraulic motor 19 through a pump 17 and a hydraulic transmission 18. It engages through a pinion which is not shown in a spur gear 20 which is mounted on the bottom of the drum 11*a*.

The water tank 15 can be supplied with water from the outside through a supply line 21 with a connecting element 22. The connecting element 22 is mounted on the back of the truck under the drum opening 11*b* and has a coupling 22*a* where the water hose is to be attached. Furthermore, from the coupling 22 a pipe 23 leads to the drum opening for the direct supply of water. The tank can supply its contents through a valve 24, the pipe 21, the coupling element 22 and the pipe 23 into the drum. The valve 24 is equipped with an electric water meter 24*a*.

Figure 2:
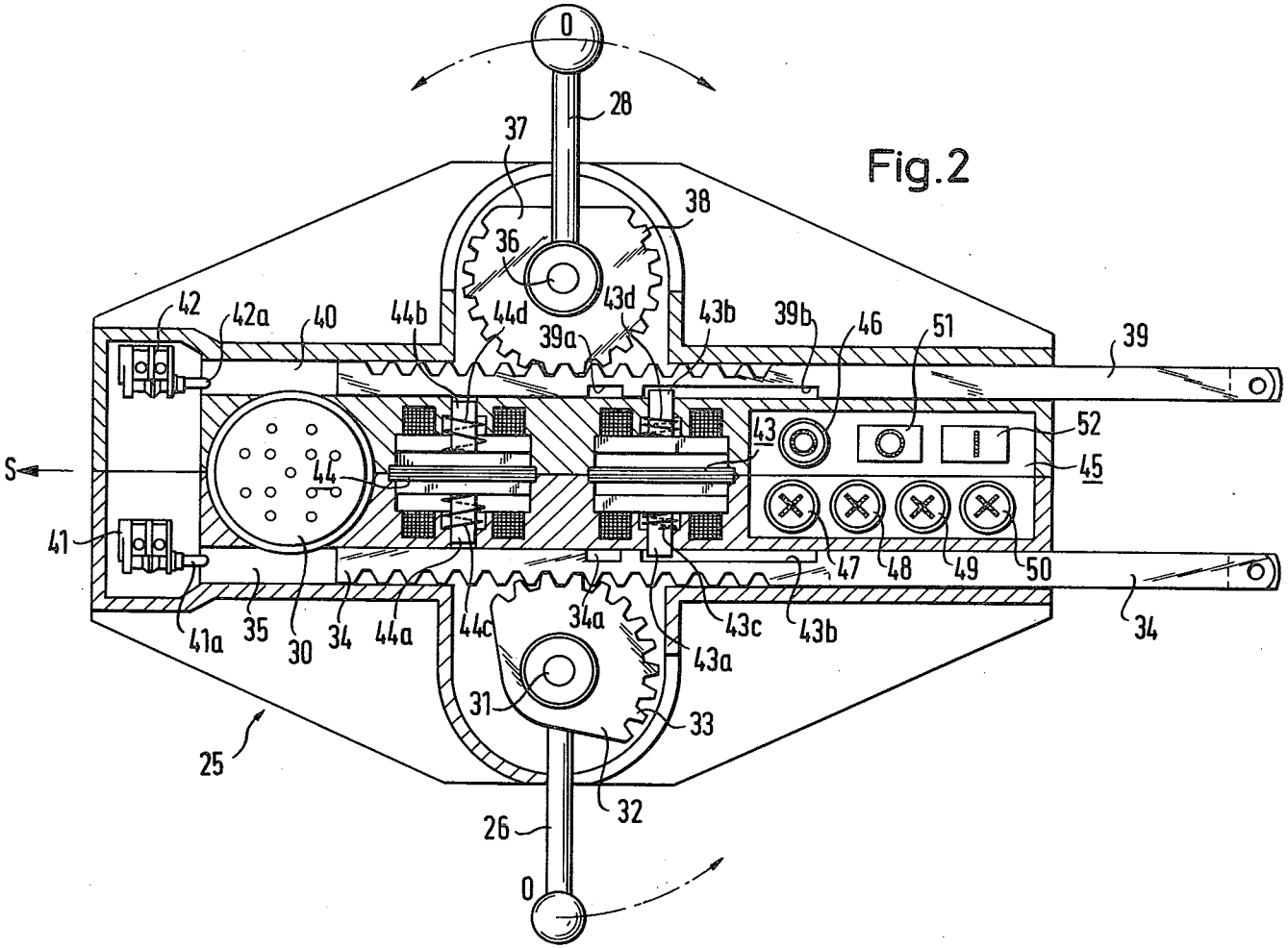
Figure 3:
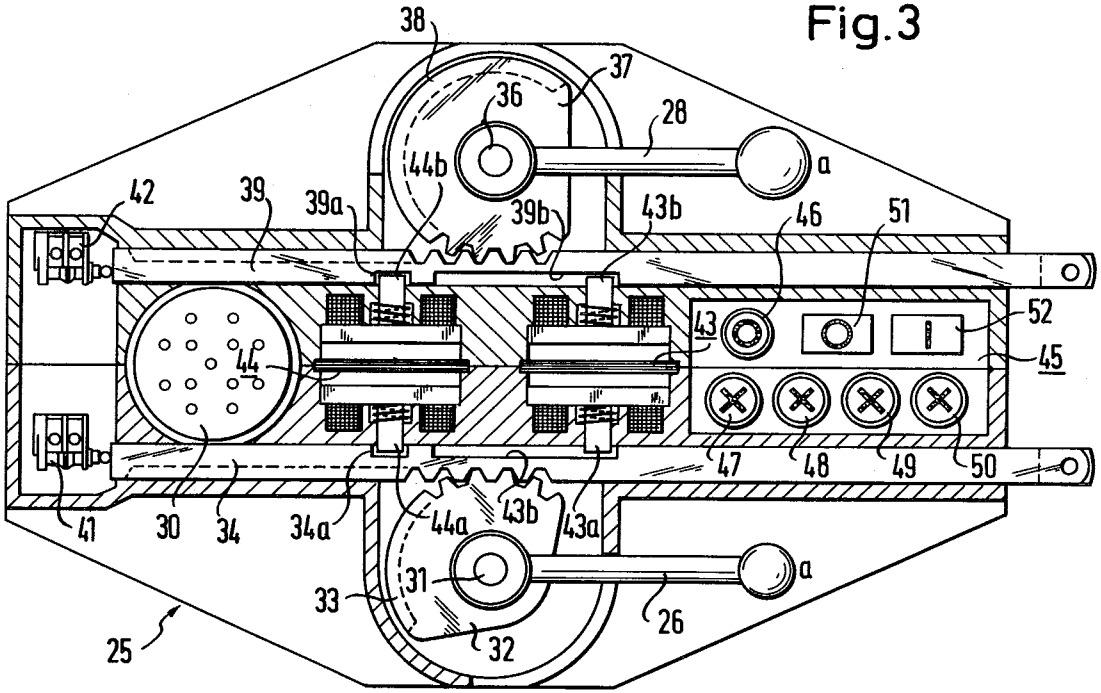
Figure 4:
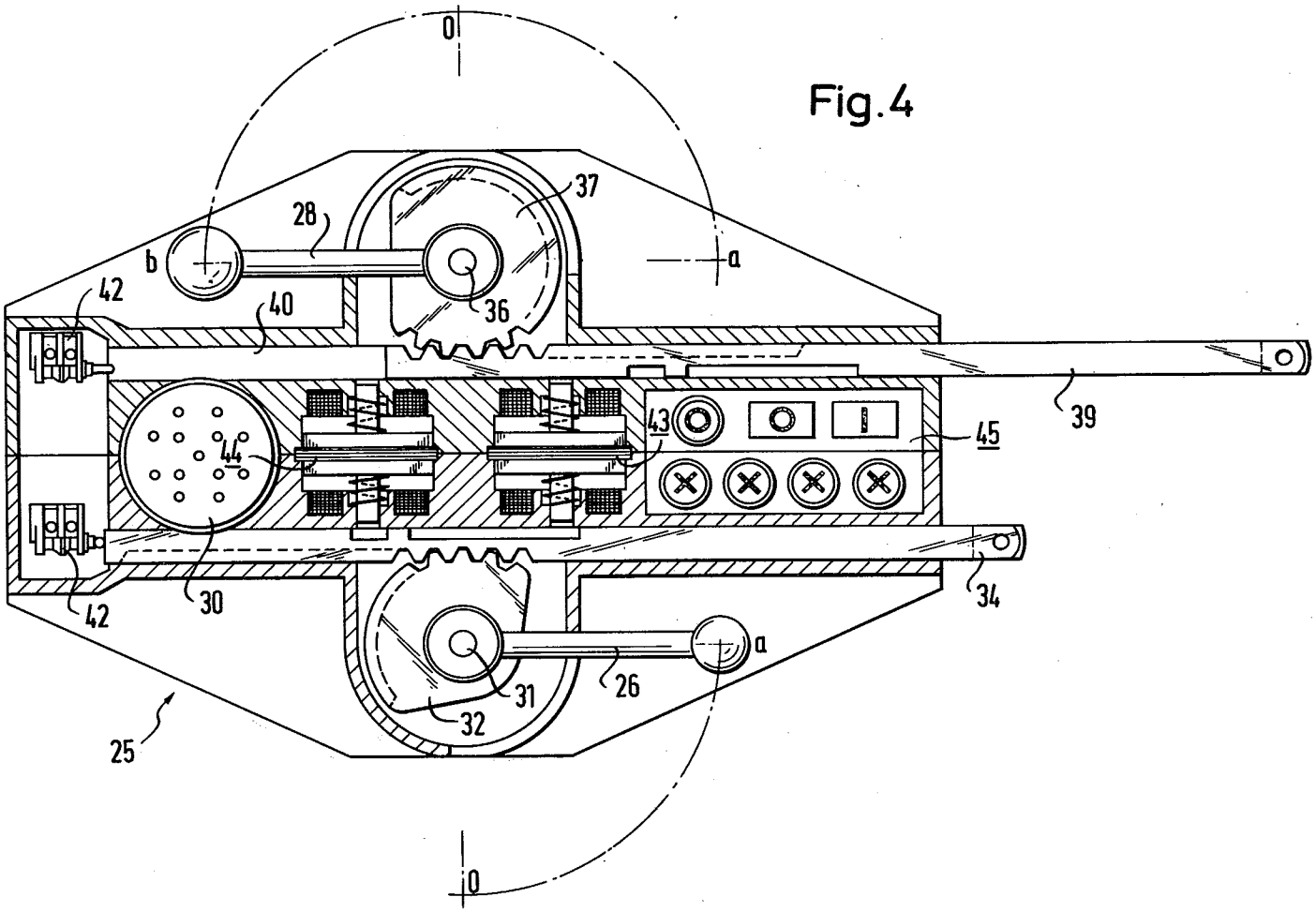

On the back of the truck a control unit 25 is mounted above the water coupling element 22. Two agitators for the drum drive are mounted on it, that is a gas lever 26, which is connected by a pipe 27 with the drive motor 16, and a mixing lever 28, which is connected by a pipe 29 with the hydraulic motor 19. Furthermore, built into the control unit 25 is a receptacle 30 to connect the control cable with the loading station. FIGS. 2 to 4 show the control unit enlarged and in cross-section, whereby the drawings differ by showing various switch positions of the actuators. In FIG. 2 the throttle lever 26 and the mixing lever 28 are both in neutral position. The throttle lever 26 rests on the control unit 25 by means of a pivot bearing 31. In its bearing area it has a segment disk 32 with a spur gear 33 in the shape of an approximate semicircle. It meshes with the first rack 34, which is movable lengthwise in a first track 35 on the control unit. The first rack 34 has a short slot 34*a* on its toothless longitudinal edge, as well as a long slot designated as 34*b*. The mixing lever 28 is located opposite the throttle lever 26, supported by means of a pivot bearing 36 and has a segment disk 37 close to the bearing with a spur gear 38 which covers a curve of approximately 270°. The spur gear 38 meshes with a second rack 39 which in a second 38 meshes with a second rack 39 which in a second track 40 is movable parallel to the first rack 34. The second rack 39 is built just like the first rack, it also has a short slot 39*a* and a long slot 39*b* on its longitudinal side opposite its toothed edge. When both actuators 26 and 28 are in neutral position, the ends of both racks and the slots will be opposite each other. Two limit switches 41 and 42 are mounted on the control unit 25 in such a manner that the switching rod 41*a* of the limit switch 41 protrudes into the first track 35 and the switching rod 42*a* of the limit switch 42 into the second track 40. Between the tracks 35 and 40 the receptacle is placed in such a manner that its edges protrude over the tracks.

The control unit further contains two electro magnets 43 and 44. They are mounted in a bilateral and symmetrical manner to an ideal connecting line between the pivot bearings 31 and 36 of the actuators 26 and 28. Each magnet features two aligned armatures 43*a* and 43*b*, resp. 44*a* and 44*b*, which are all mounted in a movable manner at right angles to the length of the racks. The armatures of each magnet are loaded with springs 43*c* and 43*d*, resp. 44*c* and 44*d* in an opposing manner so that they are pulled inside the magnet in the state of rest and are pushed to the outside against the spring force when the magnets are energized. When the agitators are in the neutral position, the armatures of the electro magnet 43 shown in the drawing on the right hand side are opposite the slots 34*b* resp. 39*b* of the racks 34 resp. 39. FIG. 2 shows the electro magnet in an energized state, whereby its armatures enagage in the large slots of the racks. This corresponds with a program situation which is to be discussed later on. FIG. 4 shows both electro magnets in a non-energized state.

The control unit furthermore contains between the tracks 35 and 40 a switch panel 45. Installed on it are an emergency switch 46, four signal lights 47, 48, 49, and 50, 2 push buttons 51 and 52 for the valve 24 between the tank and the drum.

Figure 5:
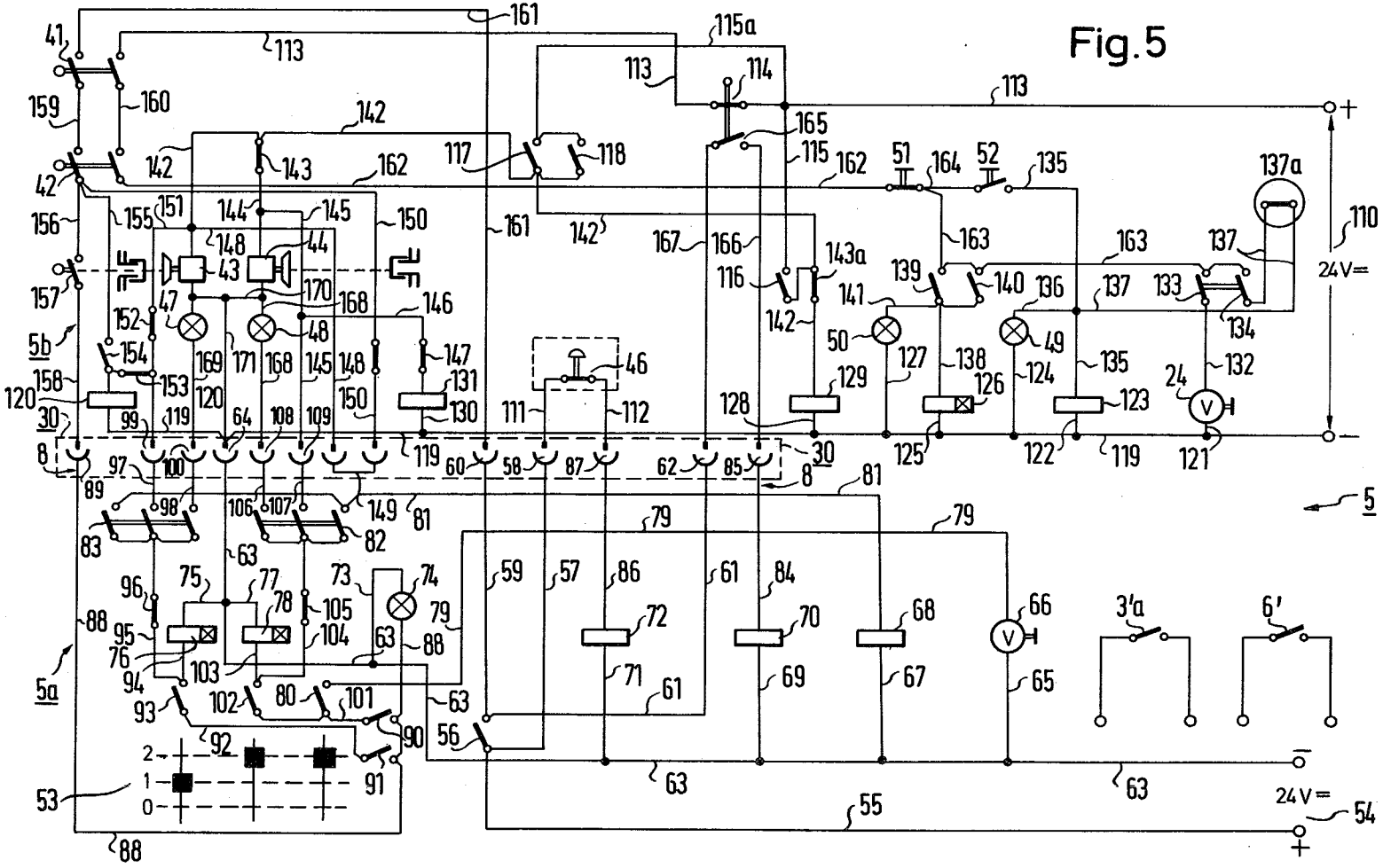

FIG. 5 shows the wiring diagram of the time switch system 5. The lower portion of the drawing shows the portion of the control unit 5*a* which is mounted on the loading station, the upper part of the drawing shows the second portion of the control unit 5*b* which is installed on the concrete mixer truck. These two portions of the control unit are coupled through connection of the control cable 8 with the receptacle 30.

The first portion of the control unit 5*a* contains the program selector 53 with the switch steps neutral (zero), first program and second program. The program selector is grouped together with a large portion of the remaining elements of the first portion of the control unit in a control station of the loading station which is not shown in FIG. 1. The first portion of the control unit 5*a* includes a power source 54 for 24 volt DC. A wire 55 runs from its plus pole to a terminal 56. A wire 57 branches before the terminal to a connection 58 in the control cable. From the terminal 56 a wire 59 leads to a connection 60 cable and another wire 61 to a connection 62 in the control cable.

From the negative pole of the power source 54 a wire 63 runs through numerous branch lines to a connection 64 in the control cable. The first branch line 65 leads to a water switching valve 66, which is located at the place of the water hose attachment 9. The next branch line 67 leads to a relay 70. The next branch line 71 leads to a relay 72. The next branch line 73 leads to a signal light 74. The next branch line 75 (to the left hand side) leads to the first time switch unit. The branch line 77 leads to the second time switch unit 78. There are no more branch lines on line 63 from here on to the connection point 64.

The water switch valve 66 is connected with a terminal 80 through a line 79. The relay 68 is connected over a line 81 and ends at a terminal 33. A line 84 leads from relay 70 to a connection 85 in the control cable 8. From relay 72 a line 86 leads to a connection 87 in the control cable.

From the signal light 74 a line runs to a connection 89 in the control cable. Terminals 90 and 91 are connected to it. The other side of the terminal 91, which can be switched through relay 72, is connected by a line 92 to a terminal 93. Its second pole is on one hand connected through a line 94 with the first time switch unit 76 and on the other hand through a line 95, which can be interrupted by an arresting switch 96, it is connected with terminal 83. The terminal 83 is three-polar, one pole is connected with line 81, the two other poles are connected through lines 97 resp. 98 with the connections 99 resp. 100 in the control cable.

A line 101 leads first from the terminal 90 to terminal 80, whose other pole is connected with line 79, and then on to a terminal 102. Its other pole is connected through a line 103 with the second time switch unit 78 and at the same time through a line 104, which can be interrupted by an arresting switch 105, it is connected to terminal 82. The terminal 82 is three-polar, one pole is connected with line 81, the other two are connected through lines 106 and 107 with the connections 108 and 109 in the control cable.

In the stationary first portion of the control unit, there is furthermore a terminal 3' a which can be loaded from relay 68 and which activates the discharge opening 3*a* of the transfer hopper, as well as a terminal 6' which is also activated by the relay 68 and which acts upon the water connection 6.

The second portion 5*b* of the control unit is mounted on the concrete mixer truck. It has a power source 110 for 24 Volt DC. Not connected with this power source is the emergency switch 46, which can be coupled through lines 111 and 112 through receptacle 30 with the connections 58 and 87 in the first portion of the control unit. The time switch installation 5 can only work if the emergency switch 46 is closed. Activation of the emergency switch interrupts the entire program cycle.

From the positive pole of the power source 110 a line 113 runs through a limit switch 114 to the limit switch 41 on the control unit 25. In front of the limit switch 114 the line 113 has a branch line 115, which leads to a terminal 116, as well as a branch line 115*a*, which leads to the terminals 117 and 118.

From the negative pole of the power source 110 a line 119 leads to a relay 120. From its branches a line 121 to valve 24 between the tank and the drum. The next branch line 122 leads to the relay 123. A further branch line 124 leads to the signal light 49. A branch line 125 leads to the third time switch unit 126. The next branch line 127 leads to the signal light 50. The branch line 123 leads to the relay 129. The last branch line from line 119 leads through line 130 to relay 131.

The tank valve 24 is connected to a terminal 133 through a line 132. It is mechanically parallel-connected with a terminal 134.

From the relay 123 a line 135 runs to the push button 52 for the tank valve. A branch line 136 runs to the other pole of the signal light 49, a further branch line 137 runs through a terminal 137*a* to terminal 134.

From the third time switch unit 126 a line 133 runs to a terminal 139 and then on to a terminal 140. From the terminal 139 a line 141 runs to the signal light 50.

From the relay 129 a line 142 runs through a terminal 143*a* to terminal 116 on one hand, and on the other hand through a pole of the terminal 117 to terminal 118 and further on to magnet 43. Before that a line 144 branches off through a terminal 143, which leads to magnet 44. Before that a line 145*ab* branches off which on one hand ends in the receptacle 30 opposite the connection 109, and on the other hand leads through a branch line 146 and a terminal 147 to relay 131. In front of the magnet 43 a line 148 branches off from line 142 which ends in control cable 8 in the receptacle 30 opposite a bridge connector 149. The bridge connector 149, in case of coupling, makes the connection to line 150 which leads to a limit switch 42 on the control unit. A further branch line 151 leads from line 142 before the magnet 43 through a terminal 152 to receptacle 30 opposite the connection 99 in the control cable. A branch line leads through a terminal 153 to a relay 120 and to a terminal 154, whose other pole is connected through a line 155 with the limit switch 42. From this pole of the limit switch 42, which is connected with lines 149 and 155, a line 156 leads to a limit switch 157, whose other pole is connected through a line 158 with the receptacle 30 opposite the connection 89 of the control cable. The limit switches 41 and 42 are bipolar, both with two parallel movable switching elements. Their poles are series-connected in pairs through lines 159 resp. 160. From one pole of the limit switch 41 a line 161 runs to the receptacle 30 opposite the connection 60. From one pole of the limit switch 42 a line 162 runs to the push button 51 for the drum valve 24. From there a line 163 leads to all the second poles of the already mentioned terminals 139, 140, 133, and 134. Furthermore, the push button 51 is connected with the push button 52 through line 164.

The limit switch 114 moves opposite to the limit switch 165 with which it is coupled, that is to say when the limit switch 114 opens, the limit switch 165 closes and vice versa. The limit switch 165 is connected with one pole to a line 165 which ends in the receptacle 30 opposite the connection 85 and with the other pole it is connected to a line 167 which ends in the receptacle 30 opposite the connection 62. From magnet 44 a line 168 runs through the signal light 48 to the receptacle 30, where it ends opposite the connection 108. From magnet 43 a line 169 goes through the signal light 47 to the receptacle 30, where it ends opposite the connection 100 of the control cable. The lines 168 and 169 are connected between the magnets and the respective signal lights through a line 170, from which a line 171 branches off to the receptacle 30, where it ends opposite connection 64. The concrete production cycle in concrete mixer trucks at the loading station is as follows:

The concrete mixer truck 2 is stationed under the transfer hopper 3 at the loading station 1 as shown in FIG. 1. The control cable 8 is plugged into the receptacle 30. The emergency switch 45 is turned off. The positive pole of the power source 54 is thus connected with a pole of switch 56 through line 55 and through line 57, connection 58, lines 111 and 112, connector 87 and line 86 it is connected with the relay 72. The negative pole of the power source 54 is connected through lines 63 and 65 with the water switch valve 66, through lines 63 and 67 with the relay 68, through lines 63 and 69 with the relay 70, through lines 63 and 71 with relay 72, through lines 63 and 73 with one pole of the signal light 74, through connector 64 and lines 170 and 168 with the magnet 44, through line 170 over line 169 with the magnet 43, and through lines 63 and 75 with the first time switch unit 76 as well as through line 77 with the second time switch unit 78.

The program selector 53 is switched to position 1 for the first cycle. This causes the relay 72 to pull up. The terminals 56 and 91 close, so that through line 59, connector 60, and line 161 the positive pole of the power source 54 of the first portion of the control unit 5*a* is connected with the limit switch 41. The throttle lever 26 must now be moved from its neutral position into the position shown in FIG. 3, that is to say it must be turned by 90°. Its segment disk 32 thereby moves the rack 34 into the direction of the arrow S. At the end of this movement it overlaps the coupling between the receptacle 30 and the control cable 8 in such a way that it locks it tightly so that it can not disengage and it, furthermore, activates the limit switch 41. This way there is power at one pole of the limit switch 42 through line 159. Position *a* of the throttle lever 26 switches the drum drive motor 16 to its maximum driving speed.

The mixing lever 28 is manually moved from its neutral position to position *a*, which switches the hydraulic motor 19 to the maximum drum driving speed in the pulling-in direction for loading resp. mixing. The mixing lever 28 moves the rack 39 through the spur gear 38 of its segment disk 37 also in the direction of arrow S. In its final position shown in FIG. 3 it constitutes a further locking device for the coupling 8–30 and activates the limit switch 42. Through the lines 149, the closed terminal 150, crossing over the plug connection and line 148 the magnet 43 is energized and, furthermore, through the lines 142, the closed terminal 143 and the line 144 the magnet 44 is also energized. Both magnets pull up, their armatures 43*a* and 43*b* resp. 44*a* and 44*b* slide into the slots 34*a* and 34*b* resp. 39*a* and 39*b* of the racks 34 and 39 and fix them in their position. At the same time the throttle lever and mixing lever are also fixed in their positions. It is now neither possible to release the coupling between the concrete mixer truck and the loading station, nor is it possible to intervene in the program cycle by activating the throttle or mixing lever, unless the emergency switch 46 is activated. The magnet 43 has closed the limit switch 157, so that through line 158, connector 89 and line 88 the signal light 74 is powered on both sides and by lighting up it indicates the stage of operation that has been achieved.

Through the already closed terminal 91 and presetting of program selector 53 the first time switch unit 76 is activated through terminal 93. It is set for loading and mixing time. The terminal 105 acts as a locking contact for the first time switch unit 76. It closes terminals 83 through the line 95 and the terminal 96. Through line 81 the relay 68 is energized and closes the terminals 3'*a* for the trap of the transfer hopper and opens the water supply 6'. At the same time the signal light 47 is energized on both sides through lines 97 and 152, and through lines 98, connector 100 and line 169, and by lighting up it shows the beginning of the loading and mixing process.

When the terminal 83 closes, the relay 120 is simultaneously energized through lines 97 and 153. It activates the terminal 66 and interrupts therewith the power connection to magnets 43 and 44 which are now held by the first time switch unit 76 through lines 97, 152, 151, and 142 on one side and through lines 169 and 170 on the other side.

Upon completion of the set loading and mixing cycle, the first time switch unit 76 releases and thus also the magnets 43 and 44. The signal light 47 goes out. At the same time the relay 68 releases. The hopper trap 3*a* and the water supply 6 close. Through the release of magnets 43 and 44, the locks for the throttle lever and mixing lever are withdrawn. They can be set in neutral position. The proper racks 34 resp. 39 move opposite to direction S, which releases the coupling 8–30. The control cable 8 can now be unplugged from the receptacle 30 and the mixer can leave the loading station. As the armatures of both magnets are in retracted position as shown in FIG. 4, the throttle lever 26 and the mixing lever 28 can be set in the "emptying" position as shown in FIG. 4, whereby the throttle lever takes position *a*, greatest drive speed, and the mixing lever takes position *b*, greatest drum drive speed, but in the opposite direction of rotation used for mixing, so that the load is moved out of the drum.

In case that loading should take place at the loading station, but mixing at another location, such as for instance the building site, the concrete production cycle is as follows:

The concrete mixer truck is stationed under the transfer hopper 3 at the loading station 1. The control cable 8 is plugged into the receptacle 30 on the control unit 25, the emergency switch 46 is turned off. At the same time the water hose 9 is attached to the coupling 22*a* on the concrete mixer truck. This activates the limit switch 114 and interrupts the power coming from the positive pole of the power source 110 on the concrete mixer truck, so that the activator switch 52 for the tank valve 24, which is located in line 162, connected through line 160 with line 113, can no longer be connected with the positive pole. This way no water can be supplied from the tank 15 to the drum 11. The limit switch 114 is coupled with the limit switch 165 in opposing direction and closes when the other opens. Through line 166, connector 85, and line 84 the relay 70 in the first portion 5*a* of the control unit is energized and closes the terminal 90. With the program selector 53 program 2 will be selected at the loading station center, that is to say the selector switch will be set in position 2. This causes the relay 72 to energize, the terminals 56 and 91 are closed, and through lines 59, connector 60, and line 161 power gets from the power source 54 of the first portion 5*a* of the control unit to the limit switch 41 which is assigned to the throttle lever 26. The throttle lever is manually moved into position *a*, maximum drive speed, and moves the rack 34 in the direction S. The rack locks the coupling between the control cable 8 and the receptacle 30 and activates the limit switch. This way one pole of the limit switch 42 is powered through line 159. The mixing lever 28 is manually moved from its neutral position to position *a*, maximum drum drive speed, in the "mixing" direction of rotation. The mixing lever 28 moves the rack 39 with the spur gear 38 of its segment disk 37 also in the direction of arrow S. In its final position it overlaps the coupling 8–30 and activates the limit switch 42. Through the lines 149, the closed terminal 150, crossing over the plug connection and line 148 the magnet 43 is energized and, furthermore, through the lines 142, the closed terminal 143, and the line 144 the magnet 44 is also energized. The armatures 43*a* and 43*b*, as well as 44*a* and 44*b* slide into the slots 34*a* and 34*b*, resp. 39*a* and 39*b* of the racks and fix them in their positions. At the same time the throttle lever and the mixing lever are also locked in their positions. The magnet 43 has closed the limit switch 157, so that through line 158, the connector 89, and the line 88 the signal light 74 is powered on both sides and indicates by lighting up that program 2 begins. Intervention in the loading process is now only possible through activation of the emergency switch 46 or through release of the coupling between the water hose 9 and the connector 22*a*. This is due to the fact that through the already closed terminal 90 and terminal 80, which is closed by position 2 of the program selector 53, the water switch valve 66 is connected with the water hose 9 through line 79. Terminal 102 closed at the same time as terminal 80 and activates the second time switch unit 78 through line 103. It is set for the loading time. A locking contact 96 is assigned to the second time switch unit 78. The second time switch unit 78 closes the terminals 82 through line 104 and terminal 105. The relay 68 is energized through line 81, pulls up and closes the terminals 3'*a* for the opening of the trap 3*a* on the transfer hopper 3 and 6' for the water supply 6. Furthermore, through closing of the terminal 82 through line 106, connector 108, and line 168 the signal light 48 indicates the beginning of the loading process.

At the same time the relay 131 is switched through lines 107, 109, and 146. It closes the terminal 116, so that the relay 129 pulls up. Relay 129 opens the terminal 143 and interrupts thus the connection of magnet 44 with the positive pole of the power source 54 of the first, stationary portion 5*a* of the control unit. At the same time terminal 117 closes, whereby the magnet 43 is connected through lines 142 and 113 with the positive pole of the power source 110 of the second portion 5b of the control unit which is installed on the concrete mixer truck. Terminal 117 is at the same time the holding contact for relay 129. The magnet 44 will be connected through line 145, connector 109, line 107, and switch 82 with the positive pole of the power source 54 until the second time switch relay runs out. As a safety precaution against power return, the terminal 152 is opened by relay 129, so that relay 120 can not pull up.

When the preset loading time runs out, the terminals 82 open, the magnet 44 releases and the signal light 48 goes out. Furthermore, the relay 68 releases and interrupts the terminals 3'a and 6' for the trap opening and the water connection.

The armatures 44a and 44b of magnet 44 meshed in the slots 34a and 39a of racks 34 and 39 when the levers were in position *a*. This locking is eliminated when the magnet 44 is no longer energized. Magnet 43 remains energized by the power source on the concrete mixer truck. This magnet position is shown in FIG. 2. The armatures 43a and 43b of magnet 43 mesh in the big slots 34b and 39b of the racks and thus permit displacement of the racks over the length of their slots. This is clearly shown in a comparison between FIG. 2 and FIG. 3. It is also possible, despite the energized magnet 43, to move both levers back to their neutral position. It is thus possible to stop the movement of the drum. Furthermore, the coupling between the control cable 8 and the receptacle 30 is released and can be detached. Magnet 43 also blocks any movement in the opposite direction of position *a*. This is not provided for the throttle lever, but for the mixing lever, for which position a means the "emptying" position. It is thus not possible to empty the drum which, at this point in the program, contains only dry components.

The water hose 9 can be detached from the connector 22a. The concrete mixer truck can now leave the loading station and drive to the intended mixing location, such as for instance the building site. Compressed air is then connected to the water tank. This closes the terminal 137a on the push button. The throttle lever 26 and the mixing lever 28 are each to be brought into position *a*, that is to say the "mixing" position. The proper racks close the limit switches 41 and 42, the control power from the power source 110 is connected to terminals 51 and 52 for the tank valve through line 113, switch 41, line 160, limit switch 42, and line 162. By pushing the valve actuator, the relay 123 pulls up through line 135 and opens the tank valve 24. Water can now run from the tank to the drum. This is indicated by a signal light 49 which has a positive connection through line 136 and negative connection through lines 124 and 119. At the same time terminal 140 is closed, which switches on the third time switch unit 126. It is set for mixing time and water adding time. The mixing process is indicated by the signal light 50 which is powered on one pole through line 141 and on the other pole through line 124. Furthermore, the third time switch unit 126 closes the contact 139 and holds it closed until mixing time is completed. At the same time terminal 143a opens and interrupts line 142 to relay 129. This closes the terminal 143 (over the magnet 44). Terminal 118 also closes, which is series-connected with terminal 143. The magnet 44 pulls up. Its armatures 44a and 44b rest in the small slots 34a and 39a of the racks and block the throttle lever and the mixing lever in their "mixing" positions *a*. At the same time terminal 147 opens, so that relay 131 can not pull up. After emptying of the tank the push button 137a opens, the relay 123 releases and the tank valve 24 closes. The signal light goes out.

At the end of the mixing time the third time switch unit 126 switches off. The magnets 43 and 44 are released and the signal light 50 goes out. The mixing process is completed and all locks for the control levers are lifted. This makes it possible to put them in neutral position or to put the throttle lever in position *a*, drive position, and the mixing lever in its position *b*, "emptying" position, and to empty the ready-mixed contents of the drum.

The invention is not limited to the example of application described here. This is intended for a loading station with dosing containers that are partitioned into chambers where cement, aggregates and possibly water are stored which are to be loaded in proportioned quantities. Within the framework of the invention it is, however, possible to build the control system in such a way that it controls at least the time for water addition.

It is, furthermore, possible to distribute the control system differently, that is to say that a portion of the switching operations could be moved from the stationary portion to the concrete mixer truck and, within limited possibilities, vice versa. The various programs resp. program sections providing operating cycles can also be regulated by fewer time switch units which can be controlled respectively. The time switch unit in the second portion of the control unit which is mounted on the concrete mixer truck retains its importance since it is responsible for sufficient mixing time away from the loading station.

The mixing time can be firmly set dependent upon the maximum time of drum rotation. In the application sample the highest rotational speed is the maximum. It is also possible, however, to select the mixing time as "adjustable" while another rotational speed is set at the same time. Furthermore, it is possible to build the control system in such a manner that the product from the rotational speed and mixing time remains constant and that thus a certain number of drum rotations is simply determined as "mixing time".

The water meter can measure the quantity of water added either when it flows in, or—since the water pressure for the filling of the tank is known—it can be set for a certain time of flow.

I claim:

1. A system to control the production of concrete in a concrete mixer truck which is loadable at a loading station and movable to another location such as a job site, said truck being equipped with a rotating drum and drive means for said drum, characterized by a control system including a time switch means for positively keeping said drive means for the drum in operation for a certain predetermined interval of mixing time, said control system comprising a first portion which is mounted at the loading station, and a second portion which is mounted on said concrete mixer truck and coupling means for releasably coupling said first and second portions.

2. A system according to claim 1 characterized by that said control system has a program selector for a first program which regulates loading and mixing at said loading station, and a second program which includes loading at said loading station and mixing at said another location.

3. A system according to claim 1 characterized by that each said portion of said control system has its own control circuit, each control circuit being provided with a power source, one power source being mounted at the loading station for said first portion and the other power source being mounted on said concrete mixer truck for said second portion.

4. A system according to claim 1 characterized by that said first portion of said control system contains said program selector.

5. A system according to claim 1 characterized by that said control system has a first time switch unit in said first portion for controlling the loading and mixing time interval.

6. A system according to claim 5, characterized by that said control system has a second time switch unit in said first portion for controlling the loading time interval.

7. A system according to claim 6 and including a water tank on said mixing truck, characterized by that said control system has a third time switch unit in said second portion which can be programmed by said program selector, and which at the end of said second program regulates the water supply from said water tank to said drum and controls said mixing time interval.

8. A system according to claim 7 including a water supply at said loading station, characterized by that said control system has a fourth time switch unit in said first portion to switch on and off said water supply from said loading station to said drum or to said tank on said concrete mixer truck.

9. A system according to claim 6, characterized by that said control system has a first locking mechanism for said coupling means between said first portion and said second portion, which first locking mechanism can be fixed or released by said first and second time switch units, whichever is operative depending upon the program selected.

10. A system according to claim 7 including an actuator for said drum drive means, characterized by that said control system has a second locking mechanism for at least one drum drive actuator which second locking mechanism can be activated, dependent upon the program selected by at least one of said time switch units.

11. A system according to claim 10, characterized by that said second locking mechanism has at least one locking element to fix said actuator in the mixing position.

12. A system according to claim 10, characterized by that said second locking mechanism has at least one locking element to block said drum from assuming the emptying position.

13. A system according to claim 10, characterized by that said second locking mechanism is mounted in a control unit on said concrete mixer truck near said actuator.

14. A system according to claim 13, characterized by that said control unit contains a coupling element and said second locking mechanism.

15. A system according to claim 14, characterized by that said coupling element comprises a control cable and a receptacle.

16. A system according to claim 15, characterized by that said control cable is installed on said loading station and said receptacle is mounted on the concrete mixer truck.

17. A system according to claim 16, characterized by that said control unit contains said second portion of said control system.

18. A system according to claim 17, characterized by that said second locking mechanism and said locking element employ the same locking components.

19. A system according to claim 18 including at least one switch actuator which pivots for switching, characterized by that said switch actuator has a rack segment which moves during switching and further including at least one movable rack mounted on said control unit which meshes with said rack segment.

20. A system according to claim 19, characterized by that said rack segment overlaps said coupling element if said switch actuator is in the mixing position.

21. A system according to claim 20, characterized by that said rack has slots into which an armature of a magnet can be locked when said switch actuator is in said mixing position.

22. A system according to claim 21, characterized by that said rack has a limit switch for a circuit of said control system which energizes said magnet in such a way that said limit switch is actuated when the drum is rotated.

23. A system according to claim 1 characterized by that said control system is equipped with a time switch unit for a minimum remixing time prior to dumping.

24. A system according to claim 1 characterized by that said interval of mixing time can be adjusted dependent upon the intended speed of drum rotation.

25. A system according to claim 24, characterized by that an electric water meter is connected to a tank valve to limit the water supply from said tank on said mixer truck.

26. A method for operating a system to control the production of concrete and wherein said system comprises a concrete mixer truck which is loadable at a loading station and moveable to another location such as a job site, said truck being equipped with a rotating drum, drive means for said drum, an actuator for said drive means, a water tank, and a programable control system including: a first portion mounted at said loading station, a second portion mounted on said concrete mixer truck, coupling means for releasably coupling said first and second portions, and a program selector for operating said control system in a first program mode to regulate loading and mixing at said loading station and operable in a second program mode for regulating loading at said loading station and mixing at said other location, the steps of: manually coupling the two said portions of said control system, setting said program selector in the first program mode, switching the actuator to mixing position, automatically locking said coupling means, automatically locking said actuator, loading said drum with all component ingredients including water, automatically operating said drum for a predetermined interval of time to effect mixing, automatically releasing said actuator and said coupling, manually moving said actuator to neutral position, and manually uncoupling said coupling means.

27. A method according to claim 26 including the steps of manually connecting said coupling means, manually connecting said tank to said water supply, manually setting said program selector in the second program mode, switching said actuator to mixing position, automatically locking said coupling, automatically locking said actuators, automatically locking said water connection, loading said drum with dry components, filling the tank with a predetermined amount of water, energizing the electric circuit of said second portion of said control system, manually releasing the hose connection and said coupling means, moving said actuators to neutral position and simultaneously blocking said drum from assuming the empty position, manually connecting compressed air to said water tank, manually switching said actuators to mixing, automatically blocking said actuators, opening said tank valve, operating said drum to effect mixing for a predetermined interval of time, closing said tank valve, and releasing said actuator.

* * * * *